US006891515B1

(12) United States Patent
Langley et al.

(10) Patent No.: US 6,891,515 B1
(45) Date of Patent: May 10, 2005

(54) MULTIBAND ANTENNA

(75) Inventors: Richard Langley, Canterbury (GB); Richard Breden, Whitstable (GB)

(73) Assignee: Harada Industry Co., Ltd., Tokyo (JP)

( * ) Notice: Subject to any disclaimer, the term of this patent is extended or adjusted under 35 U.S.C. 154(b) by 0 days.

(21) Appl. No.: 10/018,324

(22) PCT Filed: Jun. 12, 2000

(86) PCT No.: PCT/GB00/02274

§ 371 (c)(1),
(2), (4) Date: Mar. 29, 2002

(87) PCT Pub. No.: WO00/77884

PCT Pub. Date: Dec. 21, 2000

(30) Foreign Application Priority Data

Jun. 10, 1999 (GB) ..... 9913526

(51) Int. Cl.[7] ..... H01Q 1/12
(52) U.S. Cl. ..... 343/895
(58) Field of Search ..... 343/895

(56) References Cited

U.S. PATENT DOCUMENTS

| | | | | |
|---|---|---|---|---|
| 4,389,651 A | * | 6/1983 | Tomasky | 343/794 |
| 4,511,843 A | | 4/1985 | Thoraval | 324/338 |
| 5,337,063 A | | 8/1994 | Takahira | 343/714 |
| 5,363,114 A | | 11/1994 | Shoemaker | 343/828 |
| 5,905,470 A | * | 5/1999 | Fujii et al. | 343/713 |
| 6,057,803 A | * | 5/2000 | Kane et al. | 343/713 |

FOREIGN PATENT DOCUMENTS

| | | |
|---|---|---|
| EP | 0 825 674 A1 | 2/1998 |
| GB | 781672 | 8/1957 |
| GB | 1 390 514 | 4/1975 |
| GB | 2 256 750 A | 12/1992 |
| GB | 2 312 561 A | 10/1997 |
| WO | WO 97/47054 | 12/1997 |

OTHER PUBLICATIONS

Chen et al., "FDTD Analysis of Printed Square Spiral Antennas for Wireless Communications," IEEE 1997.

* cited by examiner

*Primary Examiner*—James Vannucci
(74) *Attorney, Agent, or Firm*—Dickstein, Shapiro, Morin & Oshinsky, LLP

(57) ABSTRACT

An RF antenna comprises a single conductor arranged in a generally spiral triangular form, and means for connecting the conductor to an antenna feed at or adjacent one end of the spiral, the other end of the spiral being open-circuited.

18 Claims, 10 Drawing Sheets

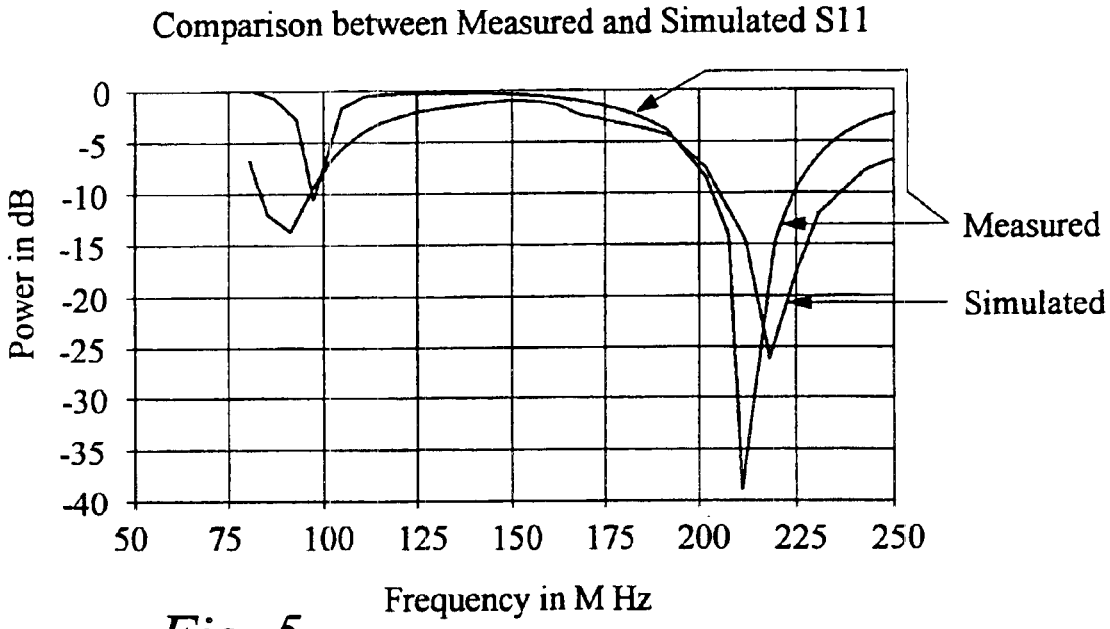
*Fig. 5*
*Fig. 8C*
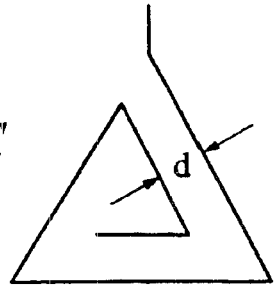

MULTIBAND ANTENNA

This invention relates to antennas, particularly but not exclusively for installation in cars or other vehicles.

With the increasing amount of media broadcasting including the new digital audio broadcasting (DAB) there is an increased need for a single antenna system to cover all bands. Ideally a system for an on car antenna should be small, low cost and unobtrusive. For most automobile communication systems a standard wire mast antenna or whip antenna is used but this is obtrusive on a car and susceptible to damage. Additional band requirements could lead to additional obtrusive antennas.

A printed or wire antenna being low profile is a good alternative and can be mounted conformably. One such form of antenna is disclosed in Helical and Spiral Antennas by Hisamatsu Nakano (Research Studies Press Ltd. 1987). Chapter II describes a two-wire square spiral antenna in which two arms of the spiral extend outwards from a feed at the centre of the spiral. This antenna radiates when the circumference of the spiral is about two wavelengths, the resultant radiation usually being circularly polarised.

The present invention adopts a completely different approach, namely a single-wire polygonal spiral whose radiating frequency bands are related to the overall length of the wire and the proximity of the successive turns of the spiral to each other. Although discussed for convenience in the context of a transmitting antenna, the invention of course applies equally to an antenna used in a receiving mode.

According to the invention there is provided a RF antenna comprising a single conductor arranged in polygonal spiral form, and means for connecting the conductor to an antenna feed at or adjacent one end of the conductor, the other end of the conductor being open-circuited, the polygonal spiral form comprising successive linear sections each forming an angle with a succeeding or preceding one, the total length of the conductor and the spacing of adjacent co-extending sections being such that the antenna exhibits resonances in a plurality of frequency bands.

Preferably, the length of the sections and the angles between them are such that the antenna is linearly polarised.

Preferably, opposite sides of the generally spiral form comprises at least three major sides which are markedly non-parallel with each other.

The invention may further be described as a RF antenna comprising a single conductor arranged in a generally spiral form, and means for connecting the conductor to an antenna feed at or adjacent one end of the conductor, the other end of the conductor being open-circuited, wherein the envelope of the generally spiral form comprises three, four or five major sides which are markedly non-parallel with each other, the total length of the conductor and the spacing of adjacent co-extending sections being such that the antenna exhibits resonances in a plurality of frequency bands.

The invention may still further be described as a RF antenna comprising a single conductor arranged in a generally spiral form, and means for connecting the conductor to an antenna feed at or adjacent one end of the conductor, the other end of the conductor being open-circuited, the envelope of the spiral form comprising three major sides disposed so as to lie in a triangular relationship, the total length of the conductor and the spacing of adjacent co-extending sections being such that the antenna exhibits resonances in a plurality of frequency bands. Preferably the one end is the outer end.

An end of each major side may merge with an end of an adjoining major side. The lengths and angles between the major sides may be such that the antenna is linearly polarised.

It will be appreciated that the spiral need not be strictly planar; for example the antenna can be conformed to a slightly curved surface such as a vehicle window or body panel. Indeed, especially if the antenna is mounted in a concealed location, it could be markedly non-planar eg. in the form of a helical spiral, provided that the functional requirements are achieved.

The aspect ratio of an overall envelope of the spiral form may be chosen such that the antenna has a required ratio of longitudinal and vertical polarisation. The overall envelope of the spiral form may be substantially in the shape of an equiangular triangle. Alternatively, it may be in the shape of an isosceles triangle, and preferably, in use, a top side of the overall envelope of the spiral is shorter than the other two sides of the overall envelope.

Co-extensive parts of the spiral form may extend parallel to each other. In a particular form of the antenna, when the antenna is disposed generally upright, from its one end the conductor may be adapted to extend upwardly at an angle, then generally horizontally, then generally downwardly at an angle to a point adjacent its one end, thereby forming a first outer side, a top outer side and a second outer side, respectively, and then to extend upwardly, horizontally and downwardly within the outer sides to form a first inner side, a top inner side and a second inner side, respectively. Preferably, the first and top inner sides are each approximately 0.8 as long as the respective first and top outer sides, and the spacing between the first outer side and first inner side and between the top outer side and the top inner side are each approximately 0.1 of the length of the first outer side. The second inner side may be approximately one-third the length of the second outer side.

By "generally co-extensive sections" is meant sections of the spiral form, which whilst not necessarily of the same length, extend generally alongside and preferably parallel to each other.

One end of the conductor may be an outer end of the spiral form.

The antenna may also also comprise a stub antenna extending from the one end of the conductor so as to be alongside an outermost portion of the spiral form, the stub antenna providing a required additional resonant frequency.

In the particular form of the antenna described above, the stub antenna preferably extends from the one end of the conductor so as to be alongside the first outer side and, more preferably, is approximately 0.4 the length of the first outer side. Even more preferably, the spacing of the stub antenna from the first outer side is approximately 0.1 the length of the stub antenna. In this configuration, the antenna has resonant frequencies at approximately 100 MHz and 220 MHz.

The antenna may be mounted on a substrate for attachment to a window or other surface.

The antenna may comprise a ground plane functionally adjacent the conductor.

Alternatively the antenna may be in combination with a further said antenna, the two antennas being arranged as a dipole.

The invention also provides a window or vehicle body panel or other vehicle fitment comprising an antenna as set forth above.

The window or panel may form a dielectric between the antenna and the ground plane.

In another aspect the invention provides a method of manufacturing an antenna, comprising disposing or defining a single conductor in a polygonal spiral form with a feed connection at or adjacent one end thereof, selecting the spacing between adjacent co-extensive sections of the polygonal spiral form and/or an overall length of the conductor such that the antenna has a plurality of required resonant frequencies. Preferably, the length and angles between successive sections of the polygonal spiral form are selected such that the antenna has a required ratio of horizontal and vertical polarisation.

Preferred features of the present invention will now be described, by way of example only, with reference to the accompany drawings, in which:

FIG. 5 shows the frequency response of the antenna of FIG. 3;

FIGS. 8 to 14 further illustrate the effects of varying the overall length of an equiangular triangular spiral antenna and varying the spacing of its turns.

Figure 15:
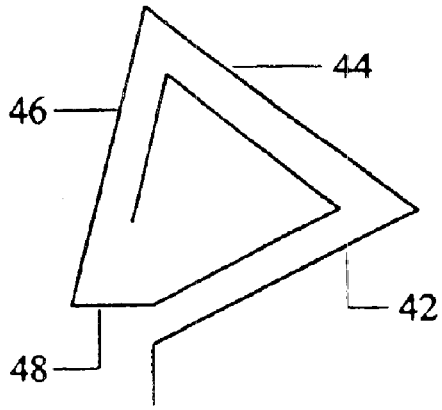
Figure 17:
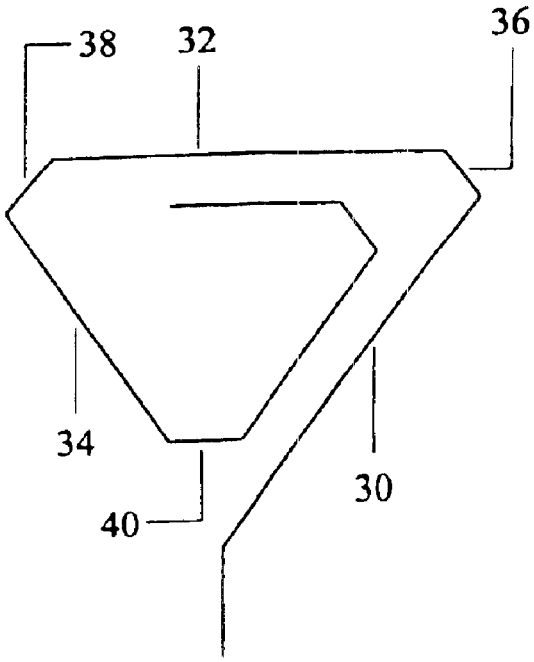
Figure 16:
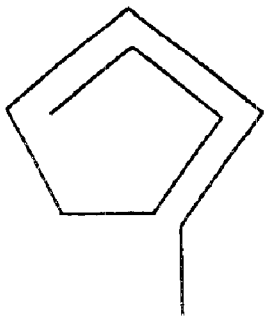

FIGS. 15, 16 and 17 illustrate further possible shapes of an antenna according to the invention.

FIGS. 18 to 21 are drawings illustrating triangular antenna radiation polarisation.

Figure 1:
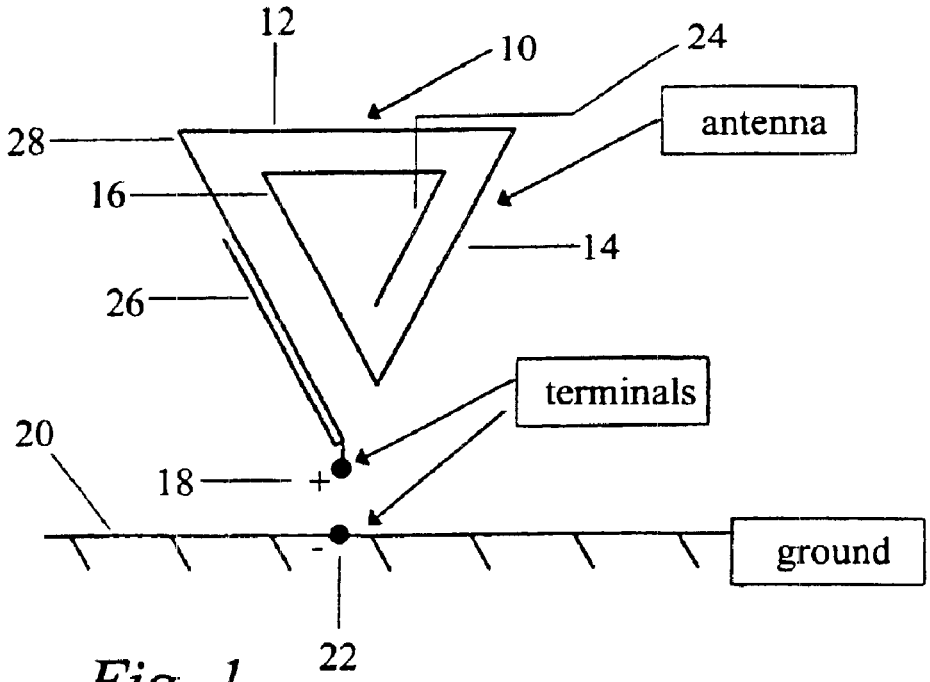
FIG. 1 illustrates a first embodiment of the antenna of the invention.

FIG. 1 shows the basic shape of one type of antenna according to the invention. It is in the form of a triangular spiral 10 in which the included angles between adjacent sides 12, 14 are equal (600) ie. each turn of the spiral, and the overall envelope of the spiral, is substantially an equilangular triangle.

The spiral consists of a single length of wire having a terminal for connection at its outer end 18 to one conductor of a co-axial transmission line. The antenna is disposed adjacent a ground plane 20, which has a terminal 22 for connection to the other (shielding) conductor of the co-axial line. Alternatively, a coplanar pair or other suitable transmission line may be used.

The spiral 10 may conveniently be printed on or embodied in the rear or other window of a motor vehicle, by known techniques, the ground plane 20 being provided by an adjacent metal panel of the car body in which the window is fitted.

Thus, in particular, the roof of the vehicle can be utilised as the ground plane. With the increasing use of plastics or other non-metallic materials for vehicle body panels and bumpers (fenders) and other vehicle body fitments, it alternatively may be convenient to embody the antenna on or in one of these parts. The antenna could be provided as a wire enclosed in a flexible film for this purpose.

The lowest (fundamental) resonant frequency is determined by the overall length and number of turns of the spiral. Because the position of the outer end is determined by the terminal 18, the innermost side of the spiral 24 may be foreshortened, eg. in FIG. 3. A further resorant frequency is attained from the spacing of the co-extensive corresponding parts of the spiral.

A stub antenna 26 is provided alongside and parallel to the outermost side 28 to provide another resonant frequency, as discussed below. Further stub antennas may be provided, preferably extending generally parallel to antenna 26 to provide yet further resonant frequencies in other bands. The resonant frequency of the stub antenna is determined primarily by its length, but may also be affected by reactive coupling to an adjacent portion of the antenna.

Figure 2:
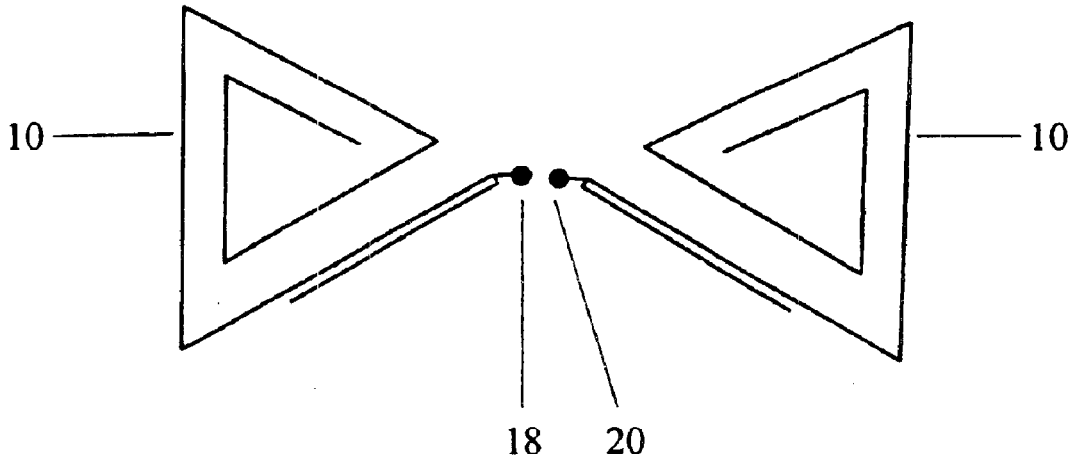
FIG. 2 illustrates a second embodiment of the antenna of the invention.

An alternative form of antenna is shown in FIG. 2. Here, two triangular spirals 10 as already described are arranged relative to each other so as to form a dipole, the ground plane being dispensed with. The terminals 18, 20 preferably are connected to a balanced transmission line or to a twisted pair with balun, as known per se.

Figure 3:
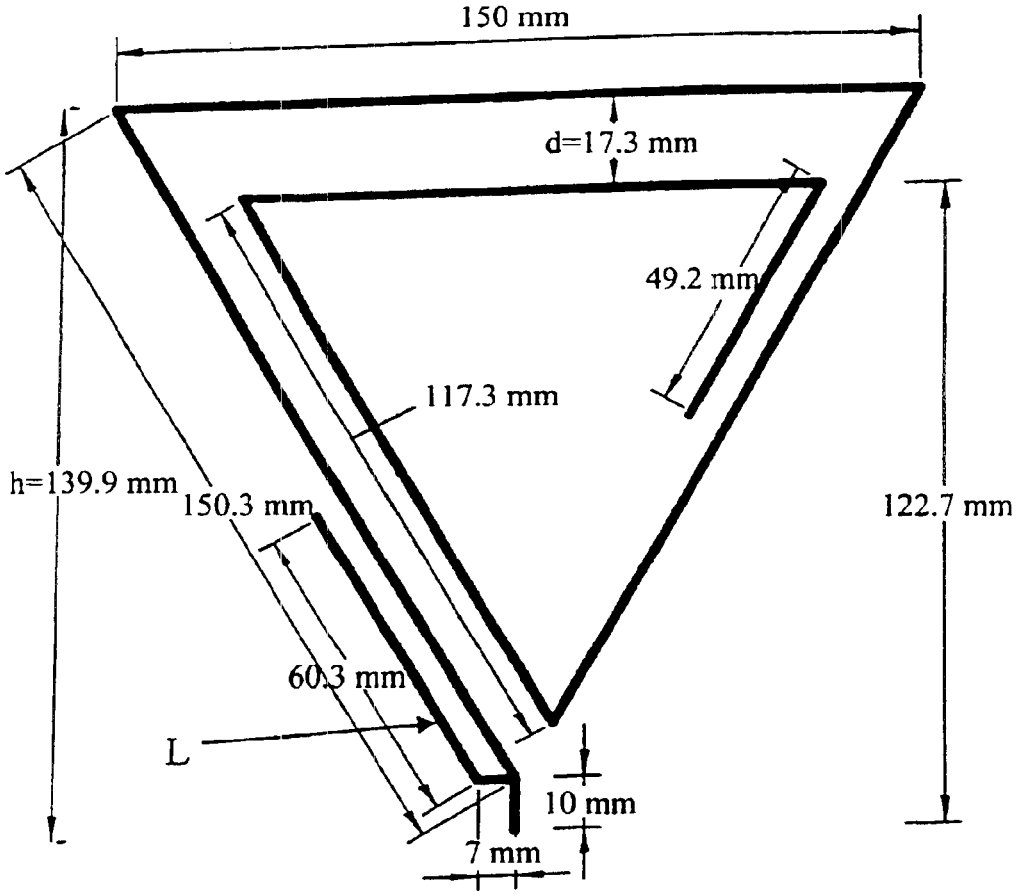
FIG. 3 is a more detailed view of the antenna of FIG. 1.

Referring to FIG. 3, the dimensions of the spiral 10 of FIG. 1 are given, as determined in a prototype which gives mixed polarisation coverage for the following bands:

AM (140–283 KHz & 526–1607 KHz)

FM European (88–108 MHz) or Japan 76–90 MHz)

DAB1 (217.5–230 MHz)

DAB2 (1452–1492 MHz)

Other frequency bands can be covered by choosing suitable dimensions for the structure, as discussed below. The antenna can incorporate an amplifier to give increased sensitivity at each band.

The side projection stub 26 provides matching at the higher frequency band (DAB2) and the remaining spiral geometry sets the lower frequency bands. The resonant frequencies of the triangular spiral can be changed by varying the values of h (the height of the antenna) and d (the conductor spacing). By varying the value of d the inductance between adjacent parts of the antenna changes and hence the loading of the structure changes, thereby changing the effective electrical length of antenna. The overall length of the line constituting the spiral antenna also can be increased or decreased thus changing the operating band frequencies and the number of operating bands. The geometry may also change so that the number of turns on the spiral increases or decreases, depending on the overall length.

Figure 4:
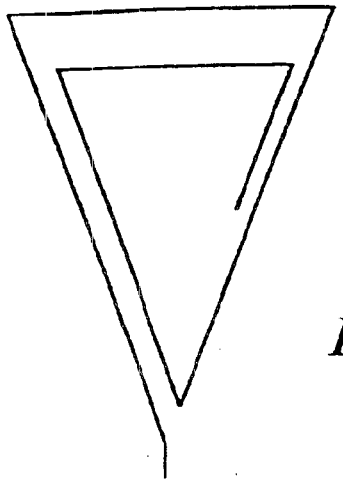
FIG. 4 illustrates a third embodiment of the antenna of the invention.

The spiral shown in FIG. 3 has equal angles. If the angles are changed, hence changing the aspect ratio, for example as shown in FIG. 4 so that the shape becomes akin to an isosceles rather than an equilangular triangle, then the ratio of vertical polarisation to horizontal polarisation power radiated will change. This is useful where mixed polarisation broadcasting is used such as FM radio and TV in the UK and provides easy adjustment with this type of antenna.

The synthesis of an antenna design from first principles is mathematically complicated, and design can with advantage be approached empirically. The main principles are as follows:

The overall length of conductor in the spiral determines the lowest operating frequency, hence a long antenna will operate at a lower frequency while a short antenna will operate at a higher frequency.

The stub 26 determines the frequency of the highest band—it resonates as a $\lambda/2$ monopole, modified by its proximity to the main conductor.

Figure 18:
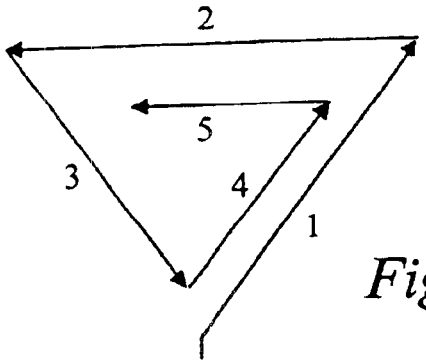

The gap between the adjacent turns or parts thereof affects several parameters. In effect the gap determines the mutual coupling between the conductors:

- a narrow gap leads to a shorter antenna;
- the gap width tunes the intermediate frequency band;
- the width of the gap determines the frequency bandwidth at the lower bands increasing the gap increases the bandwidth;
- differential gaps can be set between the sides—in other words the gaps are not all equal between each arm—this allows adjustment of the bandwidths of different frequency bands;
- horizontal to vertical polarisation ratio is determined by the lengths and selective angles of the major sides as discussed hereafter with regard to FIG. 18.

Figure 6:
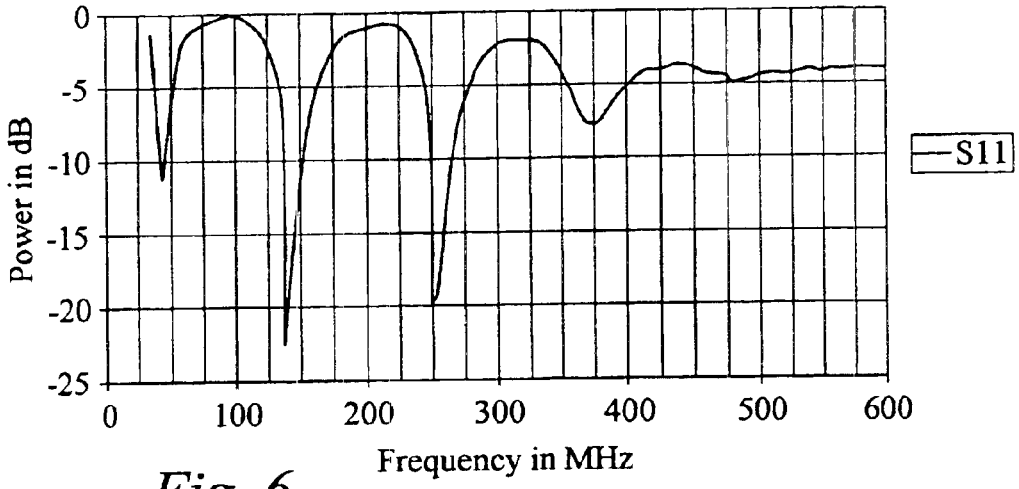
FIG. 6 shows the frequency response of an antenna with conductor length of 110 mm.

FIG. 5 plots the resonances of the antenna of FIG. 3. There are resonant frequency bands near 100 MHz, 220 MHz and 1470 MHz. The AM band does not utilise a resonant structure. FIG. 6 shows the effect of increasing the overall length from 65 mm as in FIG. 3 to 110 mm. The number of resonances increases with new resonances at 370 and 480 MHz, and the lowest frequency of resonance reduces to 40 MHz.

Sensitivity (gain) tests show that the performance of the antenna is comparable with mast antennas. The bandwidth at all bands can be improved with an active matching circuit which can also provide gain and hence the possibility of improved sensitivity.

Figure 7:
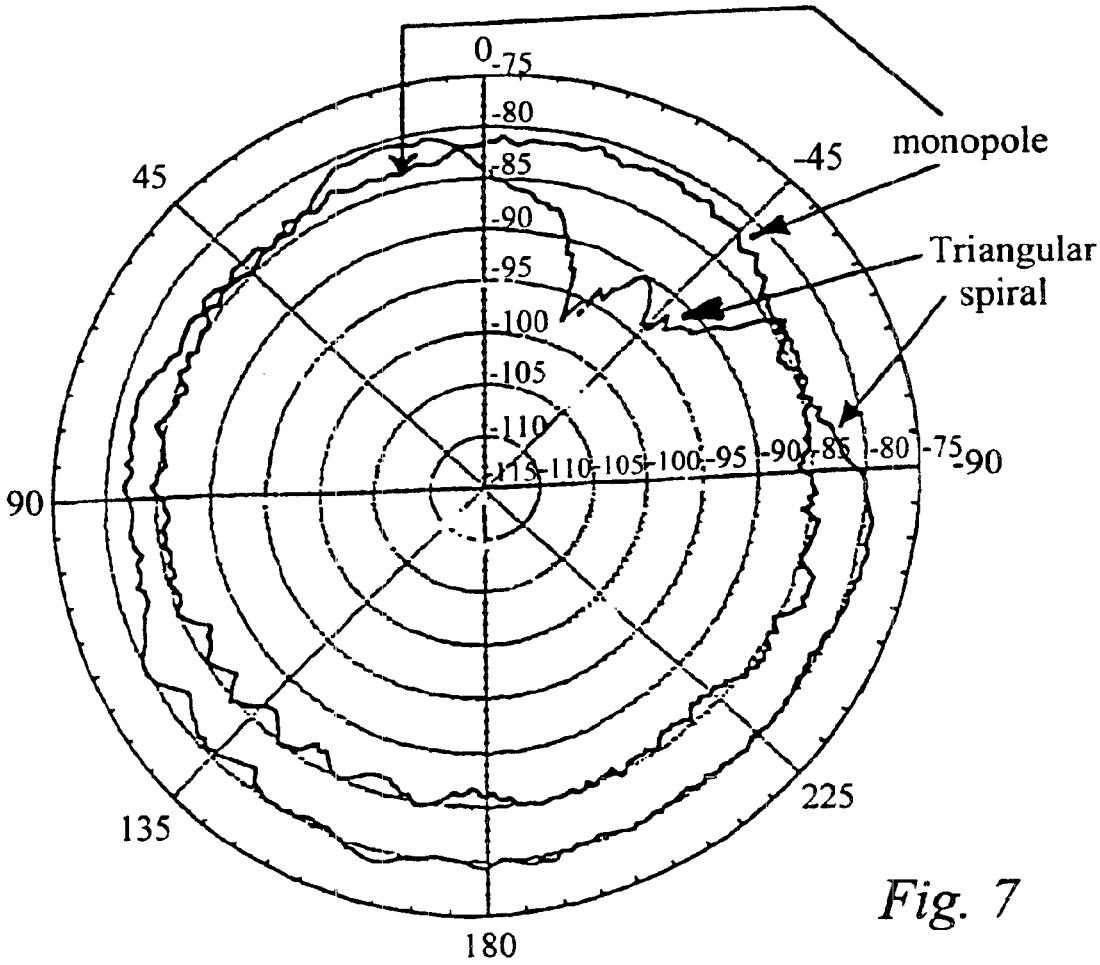
FIG. 7 shows the polar radiation pattern of the antenna of FIG. 3.

The radiation patterns in FIG. 7 show the comparison between the triangular spiral antenna of FIG. 3 mounted on the rear passenger side window of a car and a reference monopole mounted on the roof of the same car. The gain of the active spiral is higher than that of the monopole except for a null near 40° due to blocking by the c-pillar on the car. The pattern off-car is symmetrical and very similar to a monopole.

FIGS. 8 to 12 further illustrate the effects of varying the overall length of an equiangular triangular spiral antenna and the spacing of its turns. Each plot is of return loss (dB) against frequency (MHz) of an antenna configured as in FIG. 8*c*. The return loss equates to the matching of the antenna VSWR, the deeper and wider the nulls (more negative on the plot), the better the matching and the bandwidth.

Figure 8A:
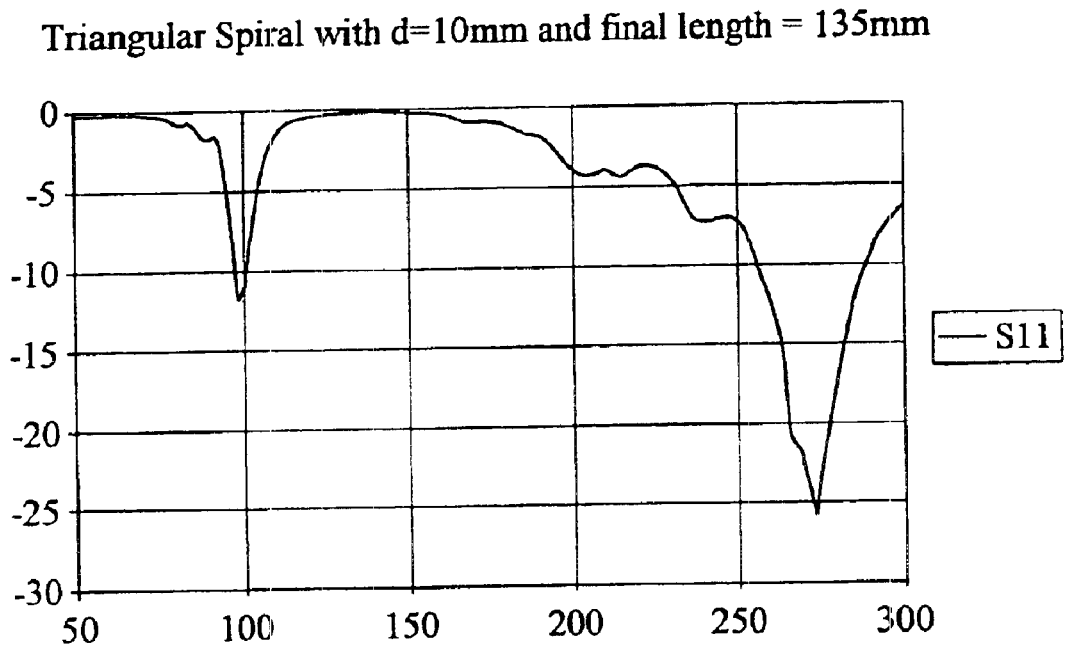
Figure 8B:
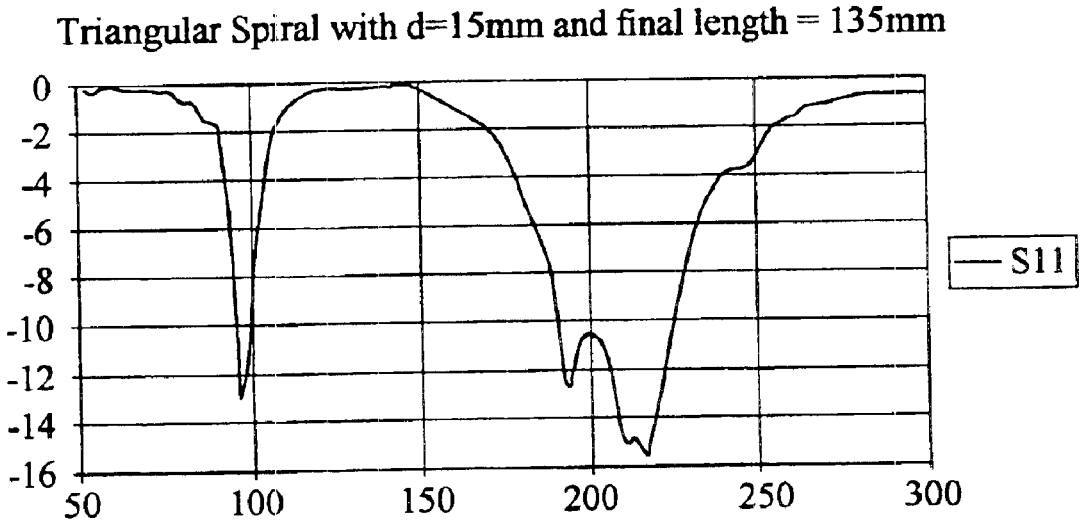
Figure 9:
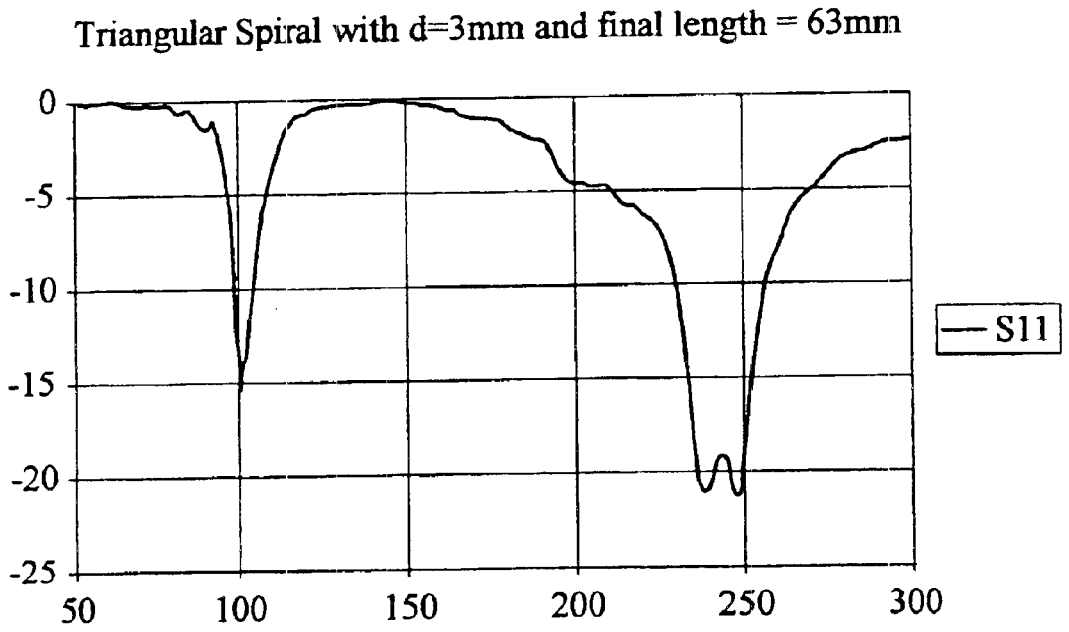
Figure 10:
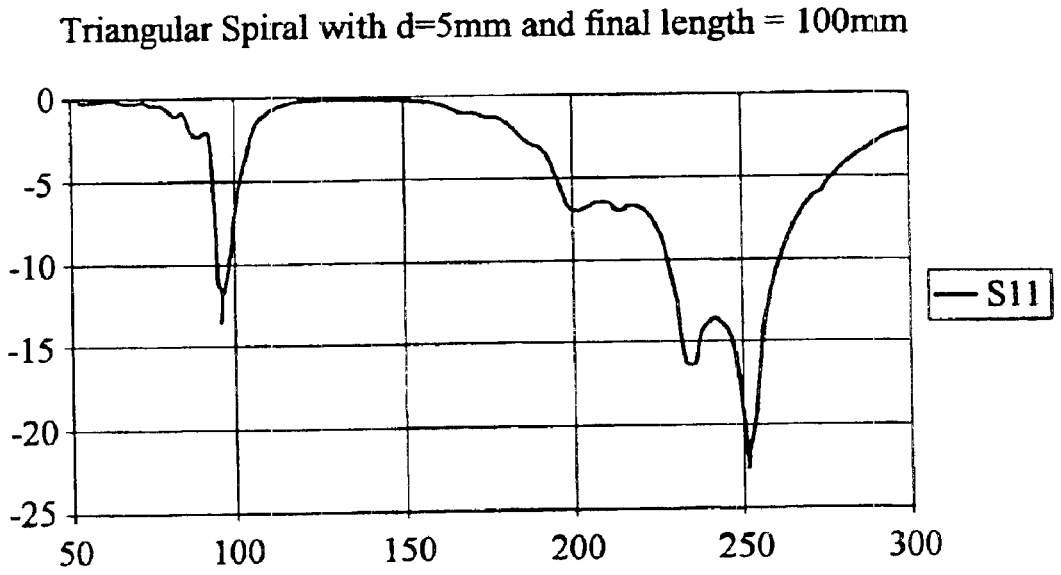
Figure 11:
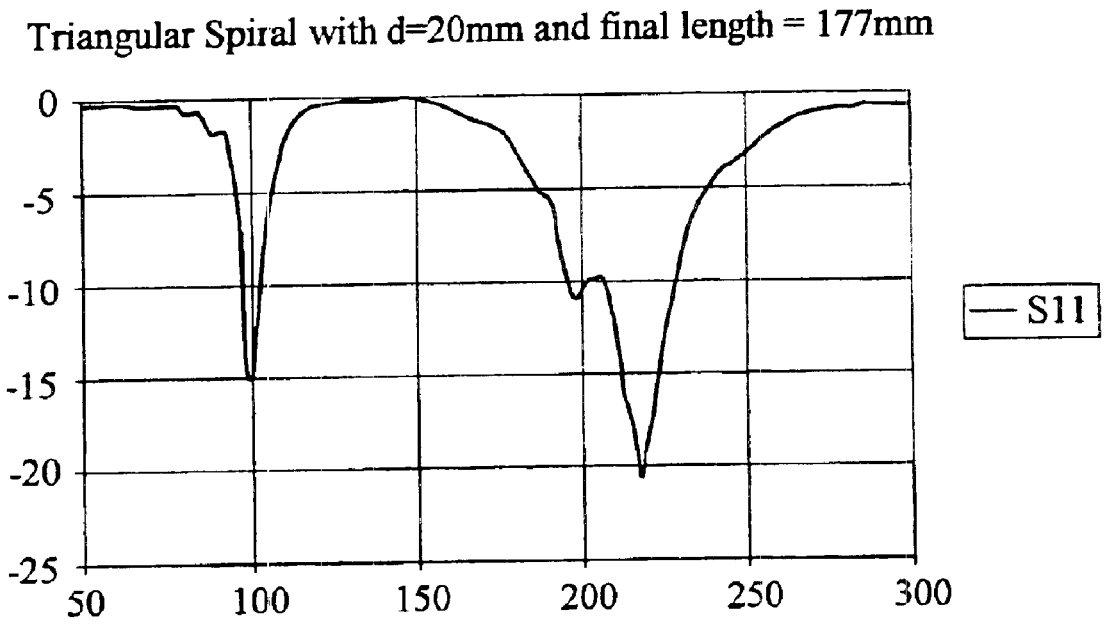
Figure 12:
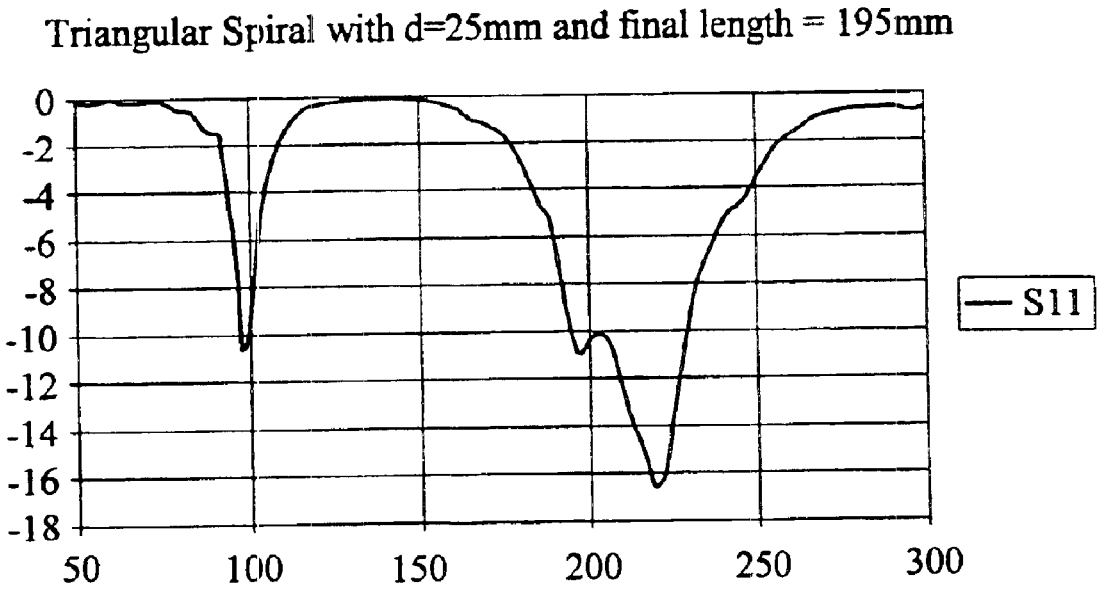

FIG. 8*a* shows the return loss of an antenna having an overall length of 135 mm, and a separation d of 10 mm. FIG. 8*b* shows the return loss for the same antenna with d increased to 15 mm. This results in a deeper null at 95 MHz, (ie. better matching of the resonance to the European FM broadcast band) and a slightly improved bandwidth. However the resonance 275 MHz is much more dependent on the spacing d and is moved to about 220 MHz, and is made much wider, resulting in better matching of the antenna to the DAB 1 band over a wider bandwidth.

The resonance for the European FM band can be maintained for varying antenna lengths by varying the spacing d. Increasing d with length can maintain this resonance at an approximately constant frequency, but the higher resonance at 200+MHz moves, so this resonance effectively can be tuned. Thus, FIG. 9 (length=63 mm, d=3 mm), FIG. 10 (length=100 mm, d=5 mm), FIG. 11 (length=177 mm d=20 mm) and FIG. 12 (length=195 mm d=25 mm) and also FIG. 8*b* (length=135 mm d=15 mm) show that an antenna for the European FM band (88–108 MHz) and the DAB 1 band (217.5–230 MHz) can be achieved with various combinations of antenna length and spacing. Thus there is considerable flexibility to tailor the antenna to the space available.

The FM band is approximately 3 meters wavelength. An antenna that has an approximate diameter of one-half wavelength will exhibit circular polarisation. The dimensions of the antenna shown in FIG. 3 has a cross-dimension (one corner to the middle of an opposite side) that is much less than one-half wavelength, and thus this antenna has negligible circular polarisation.

Figure 13:
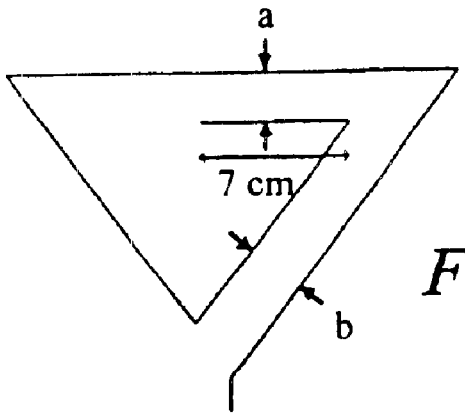
Figure 14:
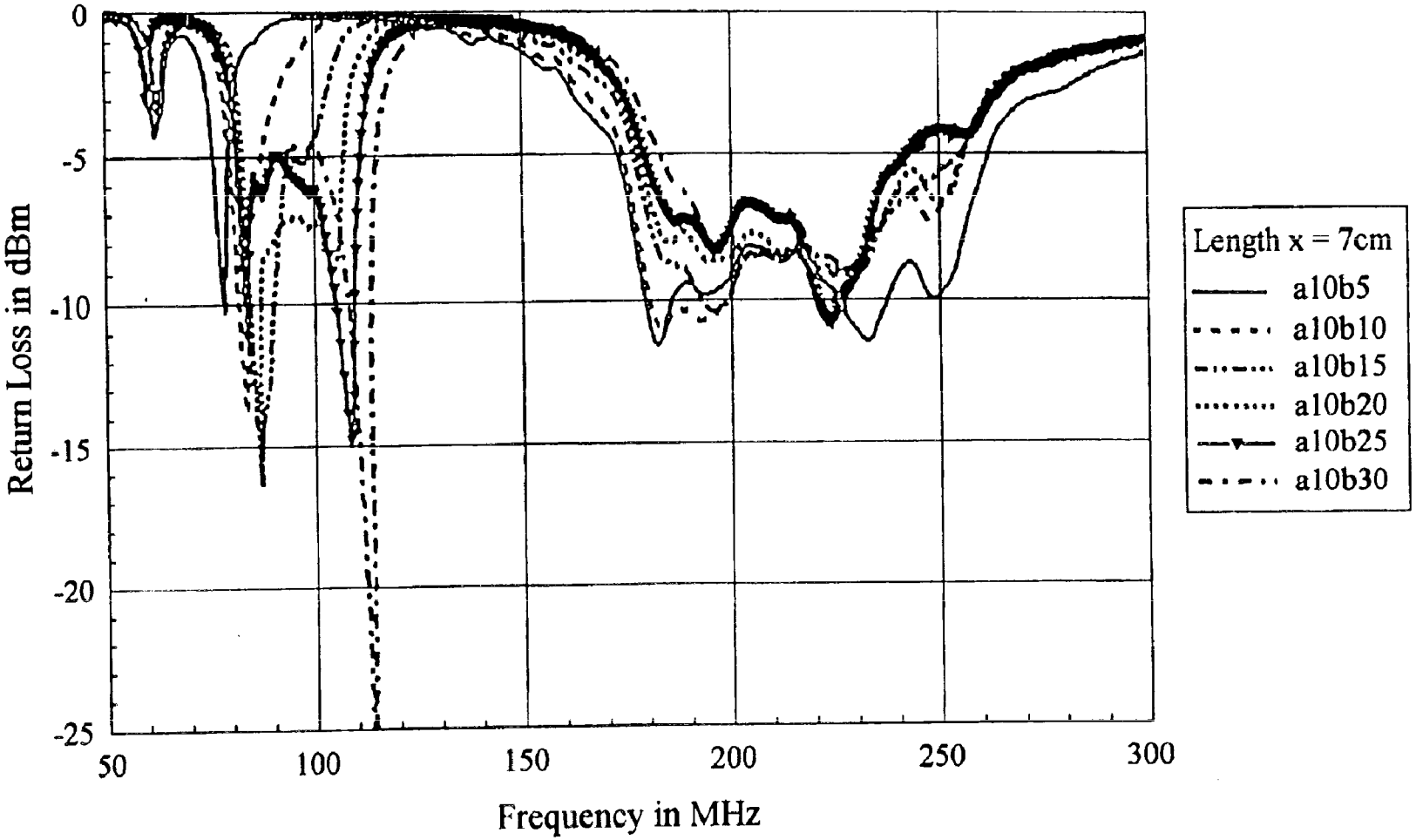

FIGS. 13 and 14 illustrate still further the effects of varying the spacing between the turns of a triangular spiral antenna. FIG. 13 illustrates the configuration of the antenna. It has a first outer side 100, a top outer side 101, a second outer side 102, first inner side 103, and top inner side 104. The first outer side 100 and first inner side 103 are parallel and spaced from each other by the gap "b". The top outer side 101 and top inner side 104 are parallel and spaced from each other by the gap "a". With the overall length of the antenna fixed and the gap "a" fixed at 10 mm, gap "b" was varied between 5 mm and 30 mm to examine the effect on resonant frequency and bandwidth. The resultant tuning and bandwidth are shown in FIG. 14.

From FIG. 14 it can be seen that the frequency bands of interest are centred on 100 MHz and 220 MHz. At 100 MHz, increasing gap "b" increases the resonant frequency. Increasing gap "b" significantly widens the band (bandwidth). At 220 MHz, the resonant frequency is approximately constant. The width of the band (at −5 dB on FIG. 14) is affected only slightly by the size of gap "b".

Several variations based on the foregoing principles are evident. For example, the spiral may be in the form of a regular or irregular triangle (adjacent parts of each turn of the conductor remaining parallel) in which opposite sides are markedly non-parallel, or the spiral may be arranged in some other regular or irregular polygonal shape. An irregular quadrilateral spiral, for example, can behave similarly to a triangular one, especially if one side of the quadrilateral is much shorter than the others so that its overall envelope tapers sharply to one end, as shown in FIG. 15. Regular polygons with six or more sides are unlikely to be effective, since they are approaching a circular outline, but a regular (FIG. 16) or irregular polygon may have utility. For example, an irregular hexagon in which very short sides alternate with long ones results in a generally triangular envelope with the corners of the triangle 'chamfered-off', as shown in FIG. 17. Such a configuration is effectively triangular and can be expected to behave as such. Effectively the three major sides 30, 32, 34 lie in a triangular relationship and are joined together and to the remainder of the spiral by intervening short sides 36, 38, 40. In contrast, in the triangular spiral of FIG. 1 or the quadrilateral or pentagonal spirals of FIGS. 15 and 16, each major side defining the envelope (42, 44, 46, 48 in FIG. 15) has an end which merges with an end of an adjoining major side. The principle remains to determine resonant frequencies by adjusting the overall length, and/or the spacing of the adjacent parts of the conductor, and/or by adjusting the aspect ratio. Adjacent lengths of conductor should normally be generally parallel, although non-parallel configurations may be found advantageous in some cases eg. for control of bandwidth.

Still in accordance with the foregoing principles, the antenna feed may be at the inner end of the spiral rather than the end. In that case the stub antenna 26 also is arranged at the inner end of the spiral.

FIG. 18 illustrates how relative horizontally and vertically polarised radiation can be adjusted. The figure shows an antenna having a triangular outer envelope and comprised of five connected linear sections '1' to '5' as shown. The radiation from the conductor is linear and the current decays as it travels along the arms so that it is strongest in arm 1 and weakest in arm 5. If the decay is linear, then on average arm 1 has 5 times the current of arm 5.

Figure 19:
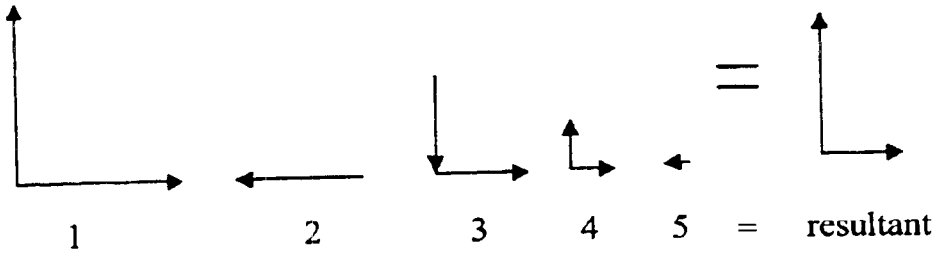
Figure 20:
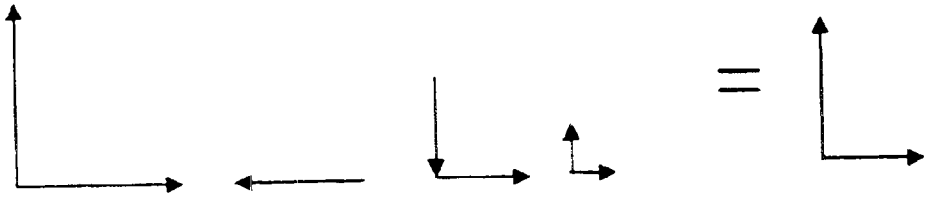
Figure 21:
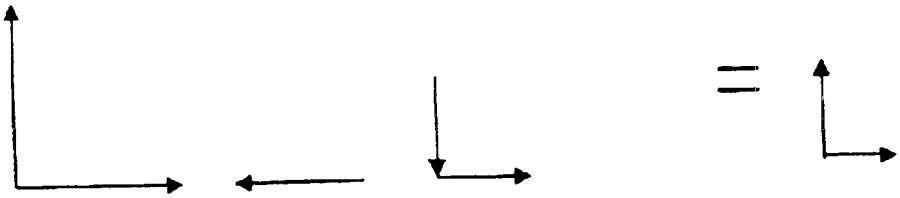

FIG. 19 illustrates the currents in the five arms of the FIG. 18 antenna resolved into horizontal and vertical vectors. The number under each of the vectors corresponds to the arm with the same number in FIG. 18. FIG. 20 illustrates the currents present if arm 5 is removed, and FIG. 21 illustrates the currents present if both arms 4 and 5 are removed.

Thus the relative strengths of the polarised radiation can be changed. In this simple illustration the resonant frequencies also will change with the change in length and configuration of the antenna, but the principle of adjusting the radiation vectors can be applied together with the other design principles set out earlier, especially by changing the lengths and relative angles of the sections of the polygonal antenna.

Each feature disclosed in this specification (which term includes the claims) and/or shown in the drawings may be incorporated in the invention independently of other disclosed and/or illustrated features.

Statements in this specification of the objects or advantages of the invention relate to preferred embodiments of the invention, but not necessarily to all embodiments of the invention falling within the claims.

The text of the abstract filed herewith is repeated here as part of the specification.

A RF antenna comprises a single conductor arranged in a generally spiral triangular form, and means for connecting the conductor to an antenna feed at or adjacent one end of the spiral, the other end of the spiral being open-circuited.

What is claimed is:

1. A RF antenna comprising a single conductor arranged in polygonal generally spiraling form, and means for connecting the conductor to an antenna feed at or adjacent to one end of the conductor, the other end of the conductor being open-circuited, the polygonal generally spiraling form comprising successive linear sections, each forming an angle with a succeeding or preceding one, the total length of the conductor and the spacing of adjacent co-extending sections being such that the antenna exhibits resonances in a plurality of frequency bands, wherein opposite sides of the generally spiraling form comprise at least three major sides that are markedly non-parallel with each other.

2. A RF antenna comprising a single conductor arranged in a generally spiraling form, and means for connecting the conductor to an antenna feed at or adjacent one end of the conductor, the other end of the conductor being open-circuited, wherein an envelope of the generally spiraling form comprises three, four, or five major sides that are markedly non-parallel with each other, the total length of the conductor and the spacing of adjacent co-extending sections being such that the antenna exhibits resonances in a plurality of frequency bands.

3. A RF antenna comprising a single conductor arranged in a generally spiraling form, and means for connecting the conductor to an antenna feed at or adjacent one end of the conductor, the other end of the conductor being open-circuited, an envelope of the generally spiraling form comprising three major sides disposed so as to lie in a triangular relationship, the total length of the conductor and the spacing of adjacent co-extending sections being such that the antenna exhibits resonances in a plurality of frequency bands.

4. An antenna as in claim 1, wherein an end of each major side merges with an end of an adjoining major side.

5. An antenna as in claim 1, wherein the lengths of and angles between the major sides are such that the antenna is linearly polarized.

6. An antenna as in claim 5, wherein the aspect ratio of an overall envelope of the generally spiraling form is chosen such that the antenna has a required ratio of horizontal and vertical polarization.

7. An antenna as in claim 2, wherein an overall envelope of the generally spiraling form is substantially in the shape of an equiangular triangle.

8. An antenna as in claim 2, wherein an overall envelope of the generally spiraling form is substantially in the shape of an isosceles triangle.

9. An antenna as in claim 8, wherein, when the antenna is disposed generally upright, a top side of the overall envelope of the spiraling form is shorter than the other two sides of the overall envelope.

10. A RF antenna consisting of a single conductor wound in a spiral configuration with one end adapted to connect to an antenna feed, the spiral configuration being formed by a set of linear sections serially connected with an angle between each successive pair, at least two of the linear sections being co-extending sections with one section positioned to extend in generally the same direction as another section but inwardly of the other section on the spiral configuration, the total length of the antenna element and the spacing of the co-extending sections being such that the antenna exhibits resonances in a plurality of frequency bands.

11. An antenna as in claim 10, wherein, when the antenna is disposed generally upright, from its one end the conductor is adapted to extend upwardly at an angle, then generally horizontally, then generally downwardly at an angle to a point adjacent its one end, thereby forming a first outer side, a top outer side, and a second outer side, respectively, and then to extend upwardly, horizontally, and downwardly within the outer sides to form a first inner side, a top inner side, and a second inner side, respectively.

12. An antenna as in claim 10, wherein the first and top inner sides are each approximately 80% as long as the respective first and top outer sides, and wherein the spacing between the first outer side and first inner side and between the top outer side and the top inner side are each approximately 10% of the length of the first outer side.

13. An antenna as in claim 11, wherein the second inner side is approximately one-third the length of the second outer side.

14. An antenna as in claim 10, and also comprising a stub antenna extending from the one end of the conductor so as to be alongside the first outer side.

15. An antenna as in claim 14, wherein the stub antenna is approximately 40% the length of the first outer side.

16. An antenna as in claim 15, wherein spacing of the stub antenna form the first outer side is approximately 10% the length of the stub antenna.

17. An antenna as in claim 16, wherein the antenna has resonant frequencies at approximately 100 MHz and 220 MHz.

18. An antenna as in claim 10, and also comprising a stub antenna extending from said one end of the conductor so as to be alongside an outermost portion of the spiraling form, the stub antenna providing a required additional frequency band.

* * * * *